US007328597B2

(12) United States Patent
Watabe et al.

(10) Patent No.: US 7,328,597 B2
(45) Date of Patent: Feb. 12, 2008

(54) CIRCUMFERENTIAL LENGTH CORRECTING METHOD AND APPARATUS FOR METAL RING

(75) Inventors: Yoshiharu Watabe, Tochigi (JP); Seiichi Minegishi, Tochigi (JP); Toru Yagasaki, Wako (JP); Hideaki Aoyama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/548,128

(22) Filed: Oct. 10, 2006

(65) Prior Publication Data

US 2007/0087879 A1 Apr. 19, 2007

(30) Foreign Application Priority Data

Oct. 19, 2005 (JP) ..... 2005-304608

(51) Int. Cl.
*B21D 15/00* (2006.01)

(52) U.S. Cl. ..... 72/111; 72/205; 72/378

(58) Field of Classification Search ..... 72/7.1, 72/11.1, 12.3, 31.08, 107, 110, 111, 205, 72/378

See application file for complete search history.

(56) References Cited

U.S. PATENT DOCUMENTS

| | | | | |
|---|---|---|---|---|
| 6,854,310 | B2 * | 2/2005 | Narusaki et al. | 72/110 |
| 7,013,691 | B2 * | 3/2006 | Shimoda | 72/110 |
| 7,140,218 | B2 * | 11/2006 | Shimoda | 72/111 |
| 7,204,005 | B2 * | 4/2007 | Fukada et al. | 29/407.05 |

FOREIGN PATENT DOCUMENTS

| | | |
|---|---|---|
| EP | 1 094 121 | 4/2001 |
| EP | 1 340 560 | 9/2003 |
| EP | 1 393 834 | 3/2004 |
| JP | 61-082910 | 4/1986 |
| JP | 63-049337 | 3/1988 |
| JP | 2-27925 | 7/1990 |
| JP | 11-290971 | 10/1999 |
| JP | 2001-105050 | 4/2001 |
| JP | 2002-178008 | 6/2002 |
| WO | 02/38302 | 5/2002 |

* cited by examiner

*Primary Examiner*—Ed Tolan
(74) *Attorney, Agent, or Firm*—Rankin, Hill, Porter & Clark LLP

(57) ABSTRACT

A circumferential length correcting method for a metal ring including: a circumferential length measuring step of passing the metal ring around a driving roller and a driven roller, displacing the driving roller and the driven roller away from each other, and measuring the actual circumferential length of the ring under tension; and a circumferential length correcting step of correcting the circumferential length of the ring by displacing a circumferential length correcting roller by a predetermined distance in a direction in which the metal ring is extended. The method is capable of imparting an appropriate arc shape to the metal ring while correcting the circumferential length to fall within an appropriate value range. Before the circumferential length correcting step, the method includes an arc-shape imparting step of displacing an arc-shape imparting roller, which has an arc-shaped circumference and is positioned inside a metal ring, by a predetermined distance in a direction in which the metal ring is extended, thereby imparting an arc shape conforming to the shape of the circumference of the arc-shape imparting roller to the metal ring.

7 Claims, 4 Drawing Sheets

CIRCUMFERENTIAL LENGTH CORRECTING METHOD AND APPARATUS FOR METAL RING

BACKGROUND OF THE INVENTION

1. Field of the Invention

The present invention relates to a method and an apparatus for correcting the circumferential length of a metal ring that constitutes a metal belt or the like of a continuously variable transmission.

2. Description of the Related Art

There have been known conventional metal belts used for continuously variable transmissions that are composed of a stack of metal rings having slightly different circumferential lengths. The metal rings are fabricated by welding the opposite edges of a thin plate of an ultra high strength steel, such as maraging steel, into a cylindrical shape, subjecting the cylinder to a first solution treatment, cutting the cylinder into rings having a predetermined width, and then rolling the resulting rings. Then, the metal rings are subjected to a second solution treatment. However, the second solution treatment causes variations in circumferential length of the rings. Thus, to form a metal belt by stacking such metal rings, the circumferential lengths of the metal rings have to be corrected.

A conventionally known circumferential length correcting apparatus comprises a driving roller for rotational driving, a driven roller capable of being displaced to move away from the driving roller, control means for controlling the displacement of the driven roller, and a circumferential length correcting roller that is positioned between the driving roller and the driven roller to correct the circumferential length of a metal ring passed around the driving roller and the driven roller (International Publication No. 2002/038302, for example).

When the circumferential length correcting apparatus corrects the circumferential length of a metal ring, the metal ring is first passed around the driving roller, the driven roller and the circumferential length correcting roller, and the control means displaces the driven roller away from the driving roller to tighten the metal ring. Then, with the driving roller being rotationally driven, the displacement of the driven roller is measured while keeping the metal ring under tension, and the control means calculates the actual circumferential length of the ring from the center distance between the driving roller and the driven roller.

Then, from the difference between the calculated actual circumferential length and the desired circumferential length, the control means calculates a displacement of the circumferential length correcting roller required to correct the circumferential length of the ring to the desired circumferential length.

Then, the control means biases the circumferential length correcting roller upward. At this time, the driven roller moves toward the driving roller by the action of the upward biasing force applied to the circumferential length correcting roller, and then the driving roller and the driven roller are held at a predetermined distance. In this state, if the circumferential length correcting roller is biased upward, the metal ring is plastically deformed, and the circumferential length correcting roller is gradually displaced upward as the plastic deformation proceeds.

Then, the control means corrects the circumferential length of the ring by displacing upward the circumferential length correcting roller until the displacement of the circumferential length correcting roller becomes equal to the calculated displacement described above.

In addition, the circumference of the circumferential length correcting roller has an arc shape with the center protruding outward in lateral cross section. Therefore, when correcting the circumferential length of the ring, an arc shape conforming to the shape of the circumference of the circumferential length correcting roller is imparted to the metal ring at the same time. When forming a metal belt by stacking such metal rings thus arc-shaped, the stack state of the rings can be readily maintained because the imparted arc-shaped surfaces are engaged with each other.

However, in the case where the arc shape is imparted to the metal ring while correcting the circumferential length of the metal ring, there are disadvantages that adjusting the circumferential length to an appropriate value may result in inappropriate imparting of the arc shape to the metal ring and that appropriately imparting the arc shape to the metal ring may result in a shift of the circumferential length from the appropriate value.

SUMMARY OF THE INVENTION

In view of such circumstances, an object of the present invention is to provide a circumferential length correcting method and a circumferential length correcting apparatus that can impart an appropriate arc shape to a metal ring and correct the circumferential length of the ring to fall within an appropriate value range.

In order to attain the object described above, the present invention provides a circumferential length correcting method for a metal ring, comprising the steps of: a circumferential length measuring step for measuring the actual circumferential length of the ring with the metal ring under tension by the driving roller and the driven roller while passing the metal ring around a driving roller and a driven roller that are capable of being displaced away from each other, and displacing the driving roller and the driven roller away from each other; and a circumferential length correcting step for correcting the circumferential length of the ring by holding the driving roller and the driven roller at a predetermined distance, and displacing a circumferential length correcting roller, which is positioned between the driving roller and the driven roller, in a direction intersecting the direction of displacement of the driving roller and the driven roller in which the metal ring is extended by a predetermined distance determined based on the actual circumferential length of the ring measured in the circumferential length measuring step, wherein, before the circumferential length correcting step, the method further comprises the step of an arc-shape imparting step for imparting an arc shape conforming to the shape of the circumference of the arc-shape imparting roller to the metal ring by displacing an arc-shape imparting roller, which has a circumference having an arc shape with the center protruding outward in lateral cross section and is positioned inside the metal ring, by a predetermined distance in a direction in which the metal ring is extended.

This circumferential length correcting method can be carried out by a circumferential length correcting apparatus for a metal ring, comprising: a driving roller and a driven roller that are capable of being displaced away from each other; a circumferential length correcting roller that is positioned between the driving roller and the driven roller and corrects the circumferential length of the metal roller by being displaced in a direction intersecting the direction of displacement of the driving roller and the driven roller in which the metal ring passed around the driving roller and the driven roller is extended; an arc-shape imparting roller that has a circumference having an arc shape with the center protruding outward in lateral cross section, is positioned inside the metal ring and imparts an arc shape conforming to the shape of the circumference thereof to the metal ring by being displaced in a direction in which the metal ring is extended; and control means for controlling displacement of the rollers, in which the metal ring is passed around the driving roller and the driven roller to correct the circumferential length of the ring.

If the circumferential length correcting step and the arc-shape imparting step are to be performed at the same time, it is difficult to appropriately impart an arc shape to the metal ring while correcting the circumferential length of the ring to fall within an appropriate value range. However, if the arc-shape imparting step is performed after the circumferential length correcting step, the circumferential length of the ring having once fallen within the appropriate value range by the circumferential length correcting step may fall out of the appropriate value range again because the arc-shape imparting roller is displaced in the direction in which the metal ring is extended in the arc-shape imparting step.

In the case of the circumferential length correcting method or circumferential length correcting apparatus of the present invention, the circumferential length of the ring is corrected by displacing the circumferential length correcting roller after an arc shape is imparted to the metal ring by displacing the arc-shape imparting roller. Therefore, an appropriate arc shape can be imparted to the metal ring while correcting the circumferential length to fall within the appropriate value range.

In addition, for example, any one of the driving roller, the driven roller and the circumferential length correcting roller may also serve as the arc-shape imparting roller. With such a configuration, a separate arc-shape imparting roller does not need to be provided in addition to the driving roller, the driven roller and the circumferential length correcting roller, so that the apparatus can be simplified.

For example, in the case where the circumferential length correcting roller also serves as the arc-shape imparting roller, after the arc-shape imparting step is performed in which the circumferential length correcting roller also serving as the arc-shape imparting roller is displaced to impart the arc shape to the metal ring, the circumferential length measuring step can be performed, and then, the circumferential length correcting step can be performed in which the circumferential length correcting roller is displaced to correct the circumferential length of the ring.

If the arc-shape imparting step and the circumferential length measuring step are performed at the same time, the total time required for the circumferential length correction can be reduced, and this is advantageous.

DETAILED DESCRIPTION OF THE PREFERRED EMBODIMENTS

Figure 1:
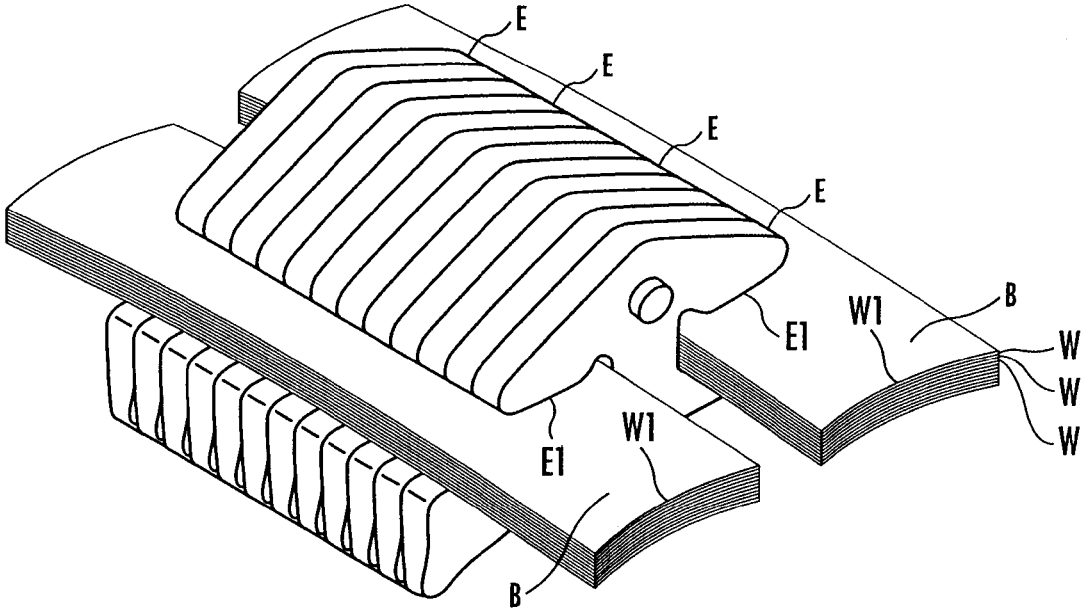
FIG. 1 is a diagram showing a part of a metal ring for a continuously variable transmission whose circumferential length is corrected by circumferential length correcting apparatuses according to embodiments of the present invention.
Figure 3:
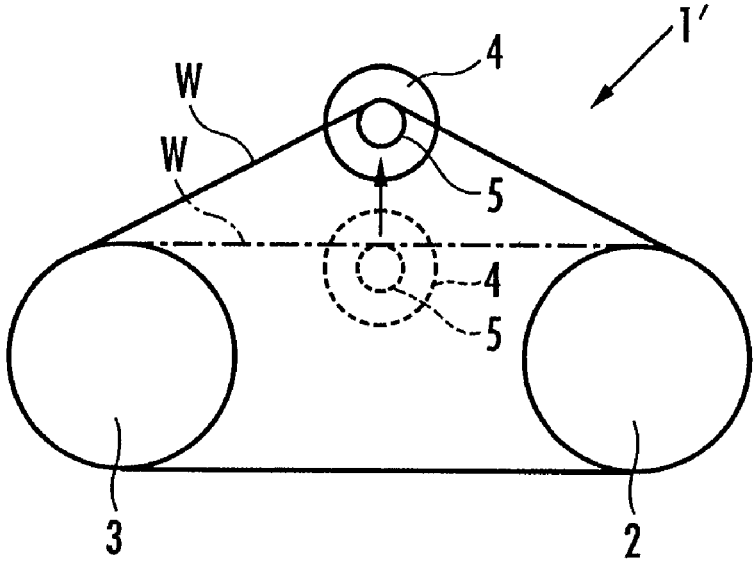
FIGS. 3(*a*) and 3(*b*) is a schematic diagram for illustrating a circumferential length correcting method using a circumferential length correcting apparatus according to a second embodiment of the present invention.
Figure 3:
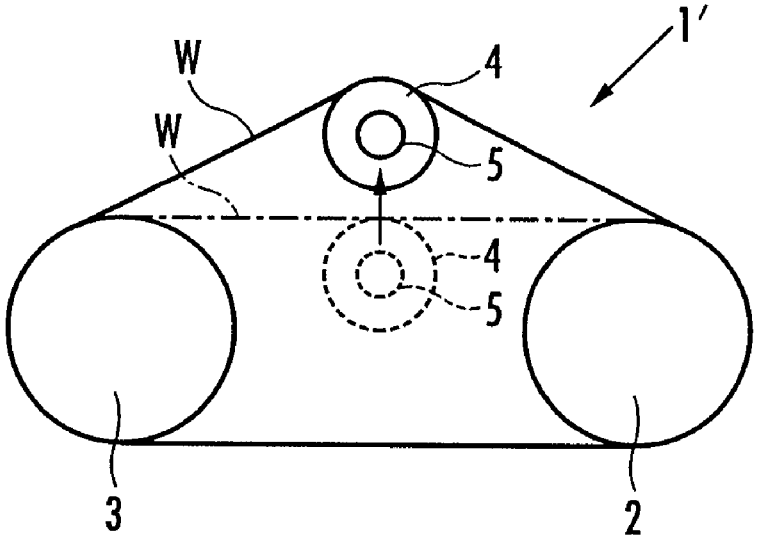
Figure 4:
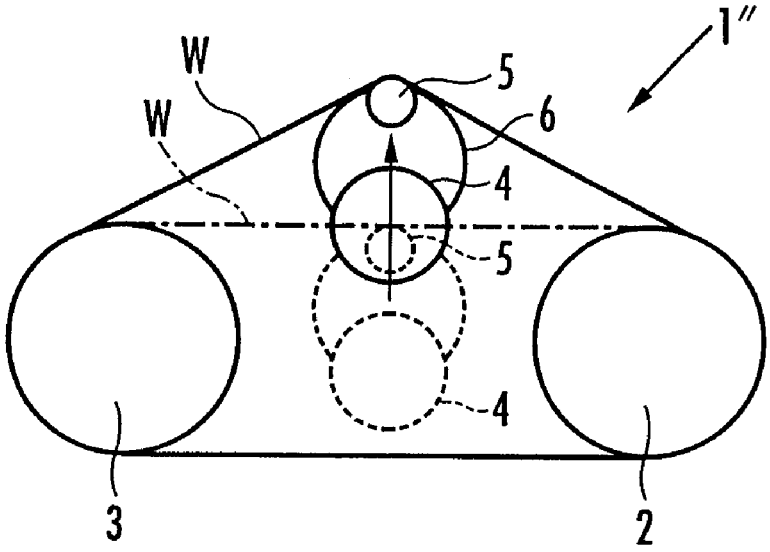
FIGS. 4(*a*) and 4(*b*) is a schematic diagram for illustrating a circumferential length correcting method using a circumferential length correcting apparatus according to a third embodiment of the present invention.
Figure 4:
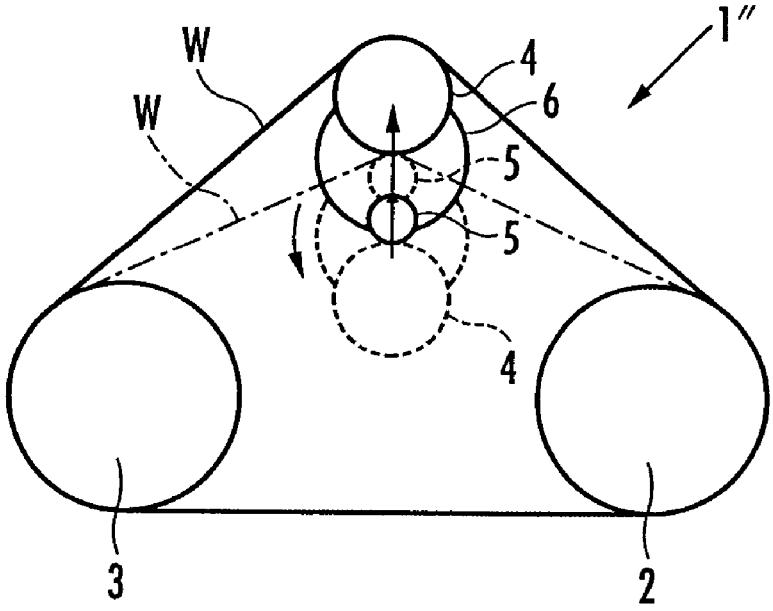

Embodiments of the present invention will be described with reference to FIGS. 1 to 4. FIG. 1 is a diagram showing a part of a metal ring for a continuously variable transmission whose circumferential length is corrected by circumferential length correcting apparatuses according to embodiments of the present invention, and FIGS. 2 to 4 are schematic diagrams for illustrating circumferential length correcting methods using circumferential length correcting apparatuses according to first to third embodiments of the present invention.

The circumferential length correcting apparatuses according to the first to third embodiments correct the circumferential lengths of metal rings W forming a metal belt B of a continuously variable transmission a part of which is shown in FIG. 1. The metal belt B is formed by stacking the metal rings W having slightly different circumferential lengths. In lateral cross section, each metal ring W has an arc shape W1 with the center protruding outward. Therefore, when the metal belt B is formed by stacking the metal rings W, the metal rings W having the arc shape W1 are engaged with each other, so that the stack state of the metal rings W can be readily maintained. In addition, a plurality of plate elements E each having a pair of recesses E1 are stacked in the thickness direction, and the metal belt B is inserted in the recess E1 of the stack. Thus, the metal rings W are integrally bound.

The metal rings W are fabricated by welding the opposite edges of a thin plate of maraging steel into a cylinder, subjecting the cylinder to a first solution treatment, cutting the cylinder into rings having a predetermined width, rolling the rings to a predetermined circumferential length, and subjecting the rings to a second solution treatment. However, the second solution treatment causes variations in circumferential length of the rings W, and thus, the varied circumferential lengths have to be corrected to the predetermined circumferential length. The circumferential length correction is carried out by a circumferential length correcting apparatus.

Figure 2:
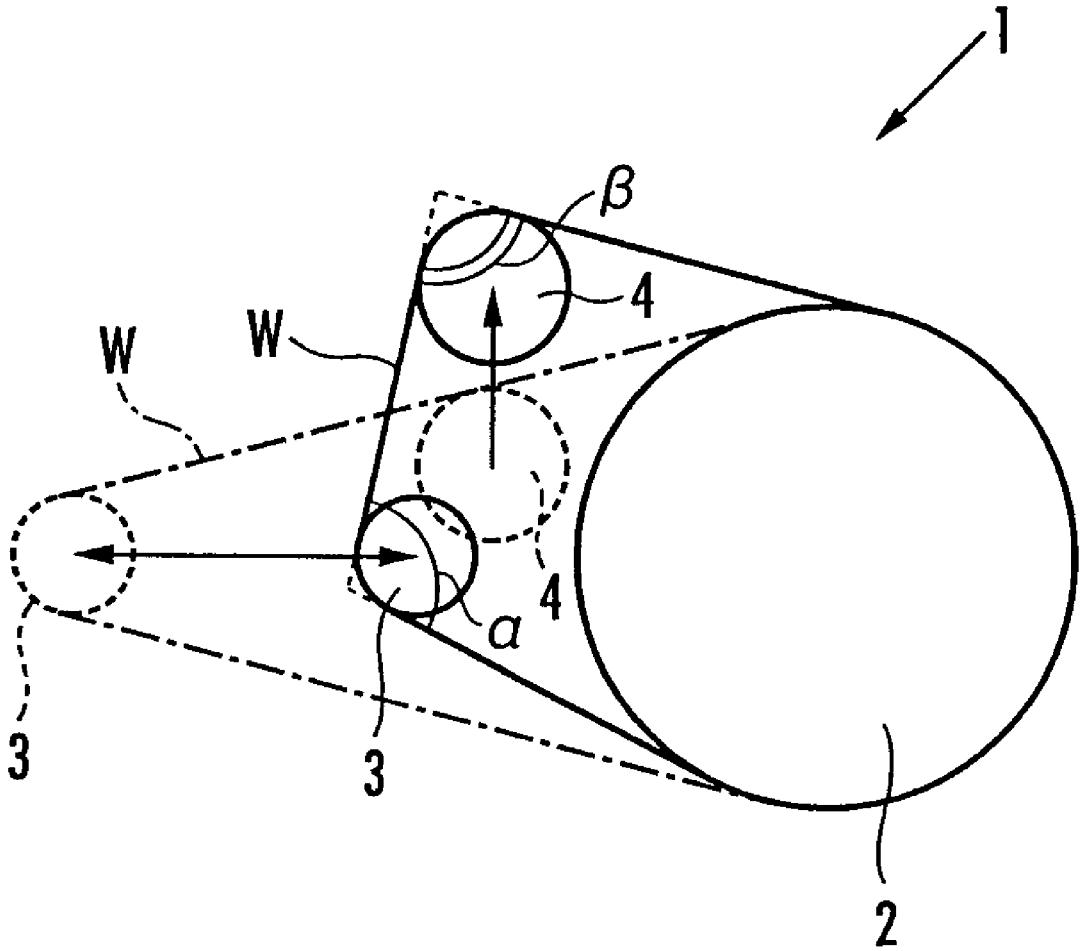
FIG. 2 is a schematic diagram for illustrating a circumferential length correcting method using a circumferential length correcting apparatus according to a first embodiment of the present invention.

As schematically shown in FIG. 2, a circumferential length correcting apparatus 1 according to the first embodiment comprises a driving roller 2 and a driven roller 3 around which a metal ring W is passed, and a circumferential length correcting roller 4 that is positioned between the driving roller 2 and the driven roller 3 and used for correcting the circumferential length of the ring W. The driving roller 2 can be rotationally driven by driver means (not shown), such as a motor. On the other hand, the driven roller 3 can be displaced away from the driving roller 2 by control means (not shown).

According to the first embodiment, the driven roller 3 also serves as an arc-shape imparting roller. Therefore, a separate arc-shape imparting roller does not need to be provided in addition to the rollers 2, 3 and 4, so that the apparatus can be simplified. In addition, the driven roller 3 also serving as the arc-shape imparting roller has a diameter smaller than those of the other rollers 2 and 4. This facilitates imparting the arc shape W1 conforming to the shape of the circumference of the driven roller 3 to the metal ring W. The circumferences of the rollers 2, 3 and 4 have an arc shape with the center protruding outward in lateral cross section. However, the rollers other than the driven roller 3 also serving as the arc-shape imparting roller, that is, the driving roller 2 and the circumferential length correcting roller 4 do not necessarily need to have the arc-shaped circumference.

Now, an operation of the circumferential length correcting apparatus 1 according to the first embodiment will be described. First, the metal ring W is passed around the driving roller 2, the driven roller 3 and the circumferential length correcting roller 4. Once the metal ring W is passed around the rollers, the driven roller 3 is moved away from the driving roller 2, thereby tensioning the metal ring W. Then, the driver means (not shown) is activated to rotationally drive the driving roller 2, and the control means determines the actual circumferential length of the ring W based on the center distance between the driving roller 2 and the driven roller 3, which is a circumferential length measuring step. At the same time, as an arc-shape imparting step, the arc shape W1 conforming to the shape of the circumference of the driven roller 3 is imparted to the metal ring W. Since the circumferential length measuring step and the arc-shape imparting step are performed at the same time, the total time required for the circumferential length correction can be reduced.

Then, the control means determines the difference between the desired circumferential length of the ring W and the actual circumferential length of the ring W calculated as described above and corrects the displacement of the circumferential length correcting roller 4 based on the difference. Then, the control means biases the circumferential length correcting roller 4 upward. This causes the driven roller 3 to be moved toward the driving roller 2, and then, the driving roller 2 and the driven roller 3 are held at a predetermined distance. In this state, the circumferential length correcting roller 4 is further biased upward, thereby causing extension and plastic deformation of the metal ring W, which is a circumferential length correcting step.

As a result, as the plastic deformation proceeds, the circumferential length correcting roller 4 is gradually displaced upward from the position shown by the phantom line in FIG. 2. The control means detects the displacement of the circumferential length correcting roller 4 and stops biasing when the detected displacement reaches a predetermined value. Then, after the circumferential length correcting roller 4 moves back to the initial position, the rotation of the driving roller 2 is stopped, the metal ring W is removed, and the operation is ended.

The predetermined distance between the driving roller 2 and the driven roller 3 in the circumferential length correcting step is preferably determined so that an angle $\alpha$ between the lines tangent to the driven roller 3 at two points where the metal ring W is in contact with the driven roller 3 is greater than an angle $\beta$ between the lines tangent to the circumferential length correcting roller 4 at two points where the metal ring W is in contact with the circumferential length correcting roller 4, as shown in FIG. 2.

According to the first embodiment, the diameter of the driven roller 3 also serving as the arc-shape imparting roller is smaller than those of the other rollers 2 and 4, thereby facilitating imparting the arc shape W1 to the metal ring W in the arc-shape imparting step. However, since the driven roller 3 has a smaller diameter, the outer circumference of the metal ring W is strongly tensioned, while the inner circumference thereof is strongly compressed. Accordingly, the residual stress in the metal ring W occurring in the arc-shape imparting step may be excessively high and be out of an appropriate value range.

Thus, if the angle a is set greater than the angle $\beta$ in the circumferential length correcting step as described above, the plastic deformation of the metal ring W by the action of the driven roller 3 can be reduced while increasing the plastic deformation of the metal ring W by the action of the circumferential length correcting roller 4, and therefore, the residual stress in the metal ring W that has increased in the arc-shape imparting step can be restored to within the appropriate value range.

With the circumferential length correcting apparatus 1 according to the first embodiment, the driven roller 3 also serving as the arc-shape imparting roller is displaced away from the driving roller 2, thereby imparting the arc shape W1 conforming to the shape of the circumference of the driven roller 3 to the metal ring W, and then, the circumferential length correcting roller 4 is displaced in a direction perpendicular to the direction of displacement of the driven roller 3 in which the metal ring W is extended, thereby correcting the circumferential length of the ring W. Thus, the arc shape W1 can be adequately imparted to the metal ring W, and the circumferential length of the ring W can be made to fall within the appropriate value range.

In the above description of the first embodiment, the arc-shape imparting step and the circumferential length measuring step are performed at the same time. However, the arc-shape imparting step can be performed at any time before the circumferential length correcting step. For example, the arc-shape imparting step can be performed before the circumferential length measuring step.

According to the first embodiment, when determining the actual circumferential length of the ring W, the driven roller 3 is moved away from the driving roller 2. Alternatively, however, the driving roller 2 may be moved away from the driven roller 3, or both the driving roller 2 and the driven roller 3 may be moved away from each other.

In the above description of the first embodiment, the driven roller 3 also serves as the arc-shape imparting roller. However, the present invention is not limited thereto, and the driving roller 2 or the circumferential length correcting roller 4 may also serve as the arc-shape imparting roller, for example. In the case where the circumferential length correcting roller 4 also serves as the arc-shape imparting roller, after the arc-shape imparting step is performed in which the circumferential length correcting roller 4 also serving as the arc-shape imparting roller is displaced to impart the arc shape W1 to the metal ring W, the circumferential length measuring step can be performed, and then the circumferential length correcting step can be performed in which the circumferential length correcting roller 4 is displaced to correct the circumferential length of the ring W.

Alternatively, for example, as in the second and third embodiments shown in FIGS. 3 and 4, an arc-shape imparting roller 5 separate from the rollers 2, 3 and 4 may be provided in the circumferential length correcting apparatus 1.

A circumferential length correcting apparatus 1' according to the second embodiment shown in FIG. 3 has the arc-shape imparting roller 5 that is coaxial with the circumferential length correcting roller 4. In addition, the circumferential length correcting apparatus 1' has advancing/retracting means (not shown) that moves the rollers 4 and 5 back and forth in a direction perpendicular to the sheet of FIG. 3 so that the arc-shape imparting roller 5 comes into contact with the inner side of the metal ring W as shown in FIG. 3(*a*) in the arc-shape imparting step, and the circumferential length correcting roller 4 comes into contact with the inner side of the metal ring W as shown in FIG. 3(*b*) in the circumferential length correcting step. The remainder of the circumferential length correcting apparatus 1' is the same as the circumferential length correcting apparatus 1 according to the first embodiment.

In the circumferential length correcting apparatus 1', in the arc-shape imparting step, as shown in FIG. 3(*a*), the advancing/retracting means moves the arc-shape imparting roller 5 in the direction perpendicular to the sheet of this drawing to a position where the arc-shape imparting roller 5 comes into contact with the inner side of the metal ring W. Then, the arc-shape imparting roller 5 is displaced in a direction in which the metal ring W is extended, thereby imparting the arc shape W1 conforming to the shape of the circumference of the arc-shape imparting roller 5 to the metal ring W. Then, the arc-shape imparting roller 5 is returned to a position where the arc-shape imparting roller 5 is out of contact with the metal ring W, the driven roller 3 is displaced away from the driving roller 2, and the actual circumferential length of the ring W is measured in the circumferential length measuring step. Then, as shown in FIG. 3(*b*), in the circumferential length correcting step, the advancing/retracting means moves the circumferential length correcting roller 4 in the direction perpendicular to the sheet of this drawing to a position where the circumferential length correcting roller 4 comes into contact with the inner side of the metal ring W, and the circumferential length correcting roller 4 is displaced by a predetermined amount in a direction in which the metal ring W is extended, thereby achieving the circumferential length correction.

A circumferential length correcting apparatus 1" according to the third embodiment shown in FIG. 4 has a table 6 that bears with shafts the arc-shape imparting roller 5 and the circumferential length correcting roller 4 on the same surface in such a manner that the rollers can rotate independently. The table 6 can be rotated to selectively bring one of the circumferential length correcting roller 4 and the arc-shape imparting roller 5 into contact with the inner side of the metal ring W. The remainder of the circumferential length correcting apparatus 1" is the same as the circumferential length correcting apparatus according to the first embodiment.

In the case of the circumferential length correcting apparatus 1", the circumferential length measuring step similar to that in the first embodiment is first performed, and then, the arc-shape imparting step is performed. In the arc-shape imparting step, as shown in FIG. 4(*a*), the table 6 is rotated to bring the arc-shape imparting roller 5 into contact with the inner side of the metal ring W, and the arc-shape imparting roller 5 is displaced via the table 6 in a direction in which the metal ring W is extended, thereby imparting the arc shape W1 conforming to the shape of the circumference of the arc-shape imparting roller 5 to the metal ring W. Then, as shown in FIG. 4(*b*), the table 6 is rotated to bring the circumferential length correcting roller 4 into contact with the inner side of the metal ring W, and the circumferential length correcting roller 4 is displaced via the table 6 by a predetermined amount in a direction in which the metal ring W is extended, thereby achieving the circumferential length correcting step of correcting the circumferential length of the ring W.

In the circumferential length correcting apparatus 1' according to the second embodiment and the circumferential length correcting apparatus 1" according to the third embodiment, the means for displacing the circumferential length correcting roller 4 (not shown) is used also for displacing the arc-shape imparting roller 5 in a direction in which the metal ring W is extended. Therefore, any separate means for displacing the arc-shape imparting roller 5 is not needed in addition to the means for displacing the circumferential length correcting roller 4, so that the structure of the circumferential length correcting apparatus can be simplified. In addition, since the arc-shape imparting roller 5 is provided separately from the driving roller 2, the driven roller 3 and the circumferential length correcting roller 4, the arc-shape imparting roller 5 is out of contact with the metal ring W in the circumferential length correcting step. Therefore, the residual stress can be readily restored to within the appropriate value range without the need of setting the angle $\alpha$ greater than the angle $\beta$ as in the first embodiment shown in FIG. 2.

Furthermore, in the circumferential length correcting apparatus 1" according to the third embodiment, the arc-shape imparting step is performed after the circumferential length measuring step, and switching between the arc-shape imparting roller 5 and the circumferential length correcting roller 4 is achieved by rotation of the table 6. Therefore, unlike the circumferential length correcting apparatus 1' according to the second embodiment, there is no need for the process of returning the arc-shape imparting roller 5 to a position where the arc-shape imparting roller 5 is out of contact with the metal ring W, moving the circumferential length correcting roller 4 to a position where the circumferential length correcting roller 4 comes into contact with the metal ring W by the advancing/retracting means and then displacing the circumferential length correcting roller 4 in a direction in which the metal ring W is extended. Thus, the total time required for the circumferential length correction for the circumferential length correcting apparatus 1" according to the third embodiment can be reduced compared with the circumferential length correcting apparatus 1' according to the second embodiment.

In the above description of the circumferential length correcting apparatus 1" according to the third embodiment, the circumferential length measuring step, the arc-shape imparting step and the circumferential length correcting step are performed in this order. However, the present invention is not limited thereto, and the arc-shape imparting step may be first performed, and then the circumferential length measuring step and the circumferential length correcting step may be performed in this order. In this case, for example, after the arc-shape imparting roller 5 imparts the arc shape W1 to the metal ring W, the arc-shape imparting roller 5 can be displaced together with the table 6 to the original position before displacement, and then the circumferential length measuring step can be performed.

What is claimed is:

1. A circumferential length correcting method for a metal ring, comprising the steps of:

a circumferential length measuring step for measuring the actual circumferential length of the ring under tension while passing the metal ring around a driving roller and a driven roller that are capable of being displaced away from each other, and displacing the driving roller and the driven roller away from each other; and a circumferential length correcting step for correcting the circumferential length of the ring by holding the driving roller and the driven roller at a predetermined distance, and displacing a circumferential length correcting roller, which is positioned between the driving roller and the driven roller, in a direction intersecting the direction of displacement of the driving roller and the driven roller in which the metal ring is extended by a predetermined distance determined based on the actual circumferential length of the ring measured in the circumferential length measuring step, wherein, before said circumferential length correcting step, the method further comprises the step of an arc-shape imparting step for imparting an arc shape conforming to the shape of the circumference of the arc-shape imparting roller to the metal ring by displacing an arc-shape imparting roller, which has a circumference having an arc shape with the center protruding outward in lateral cross section, the diameter of which is smaller than those of the driving roller or the driven-roller and the circumferential length correcting roller and is positioned inside said metal ring, by a predetermined distance in a direction in which the metal ring is extended.

2. The circumferential length correcting method for a metal ring according to claim 1, wherein said driving roller or driven roller also serves as said arc-shape imparting roller, and said arc-shape imparting step is performed at the same time as said circumferential length measuring step.

3. The circumferential length correcting method for a metal ring according to claim 2, wherein the predetermined distance between said driving roller and said driven roller is determined in said circumferential length correcting step so that an angle $\alpha$ between the lines tangent to said driven roller at two points where the metal ring is in contact with said driven roller is greater than an angle $\beta$ between the lines tangent to said circumferential length correcting roller at two points where the metal ring is in contact with said circumferential length correcting roller.

4. A circumferential length correcting apparatus for a metal ring, comprising:

a driving roller and a driven roller that are capable of being displaced away from each other;

an arc-shape imparting roller that has a circumference having an arc shape with the center protruding outward in lateral cross section, which is a roller identical to any one of said driving roller and said driven roller, the diameter of which is smaller than those of another of said driving roller and said driven roller, and which imparts an arc shape conforming to the shape of the circumference thereof to the metal ring by being displaced in a direction in which the metal ring passed around these rollers is extended; and a circumferential length correcting roller, the diameter of which is larger than said arc-shape imparting roller, that is positioned between the driving roller and the driven roller and that corrects the circumferential length of the metal ring by being displaced in a direction intersecting the direction of displacement of the driving roller and the driven roller in which the metal ring is extended.

5. A circumferential length correcting apparatus for a metal ring, comprising:

a driving roller and a driven roller that are capable of being displaced away from each other;

a circumferential length correcting roller that is positioned between the driving roller and the driven roller and corrects the circumferential length of the metal ring by being displaced in a direction intersecting the direction of displacement of the driving roller and the driven roller in which the metal ring passed around the driving roller and the driven roller is extended;

an arc-shape imparting roller that has a circumference having an arc shape with the center protruding outward in lateral cross section, the diameter of which is smaller than those of the driving roller or the driven roller and the circumferential length correcting roller, and which is positioned inside said metal ring and imparts an arc shape conforming to the shape of the circumference thereof to the metal ring by being displaced in a direction in which the metal ring is extended; and control means for controlling displacement of the rollers, wherein, before the circumferential length of the ring is corrected by said circumferential length correcting roller, the controller controls said arc-shape imparting roller so that said arc-shape imparting roller is displaced by a predetermined distance in a direction in which the metal ring is extended.

6. A circumferential length correcting apparatus for a metal ring according to claim 5, wherein said arc-shape imparting roller is coaxial with said circumferential length correcting roller, and the apparatus further comprises advancing/retracting means that moves said circumferential length correcting roller and said arc-shape imparting roller back and forth so that said arc-shape imparting roller comes into contact with the inner side of the metal ring in the arc-shape imparting step, and said circumferential length correcting roller comes into contact with the inner side of the metal ring in the circumferential length correcting step.

7. A circumferential length correcting apparatus for a metal ring according to claim 5, wherein the apparatus further comprises a table that bears with shafts the arc-shape imparting roller and the circumferential length correcting roller on the same surface in such a manner that the rollers can rotate independently, and said table can be rotated to selectively bring one of said circumferential length correcting roller and said arc-shape imparting roller into contact with the inner side of the metal ring.

* * * * *